US006984615B2

(12) United States Patent
Kenmochi et al.

(10) Patent No.: US 6,984,615 B2
(45) Date of Patent: Jan. 10, 2006

(54) CLEANING ARTICLE

(75) Inventors: Yasuhiko Kenmochi, Kagawa (JP); Masatoshi Fujiwara, Kagawa (JP); Yoshinori Tanaka, Kagawa (JP); Yoshiko Saida, Kagawa (JP); Kodai Furuya, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 345 days.

(21) Appl. No.: 10/250,384

(22) PCT Filed: Dec. 19, 2001

(86) PCT No.: PCT/JP01/11131

§ 371 (c)(1),
(2), (4) Date: Jun. 25, 2003

(87) PCT Pub. No.: WO02/053694

PCT Pub. Date: Jul. 11, 2002

(65) Prior Publication Data

US 2004/0053806 A1 Mar. 18, 2004

(30) Foreign Application Priority Data

Dec. 27, 2000 (JP) ..... 2000-397601

(51) Int. Cl.

| | |
|---|---|
| ***C11D 1/74*** | (2006.01) |
| ***C11D 17/04*** | (2006.01) |
| ***A47L 13/16*** | (2006.01) |
| ***D06M 13/17*** | (2006.01) |
| ***D06M 13/224*** | (2006.01) |

(52) U.S. Cl. ..... 510/295; 510/353; 510/356; 510/360; 510/438; 510/439

(58) Field of Classification Search ..... 510/295, 510/353, 356, 360, 438, 439
See application file for complete search history.

(56) References Cited

U.S. PATENT DOCUMENTS

2004/0053806 A1 * 3/2004 Kenmochi et al. ..... 510/438

FOREIGN PATENT DOCUMENTS

| | | | |
|---|---|---|---|
| EP | WO 97/29178 | * | 8/1997 |
| JP | 38-23295 B | | 11/1963 |
| JP | 47-16958 B | | 5/1972 |
| JP | 06-017087 A1 | | 1/1994 |
| JP | 2000-273492 A1 | | 10/2000 |
| WO | WO 97/29178 A1 | | 8/1997 |

* cited by examiner

*Primary Examiner*—Brian P. Mruk
(74) *Attorney, Agent, or Firm*—Darby & Darby

(57) ABSTRACT

Disclosed is a cleaning article including fibers having at least a surfactant adhered thereto, wherein the surfactant is a mixture that contains from 45 to 76% by weight of a polyoxyethylene (POE) monoester of a fatty acid having from 5 to 15 carbon atoms, and the balance of the mixture is at least one compound selected from the group consisting of a POE monoester of a saturated fatty acid having from 16 to 22 carbon atoms, a POE monoester of an unsaturated fatty acid having from 16 to 22 carbon atoms, a POE diester of an unsaturated fatty acid having from 16 to 22 carbon atoms, and a POE diester of a saturated fatty acid having from 12 to 15 carbon atoms.

23 Claims, 2 Drawing Sheets

CLEANING ARTICLE

BACKGROUND OF THE INVENTION

1. Field of the Invention

The present invention relates to cleaning articles, for example, those of a wiper type, of which the electrostatic ability to adsorb dust has been especially improved.

2. Description of the Related Art

Various cleaning articles for daily housecleaning are known in the art. Such cleaning articles typically comprise fibers for collecting dust. For examples, the fibers are made into a nonwoven fabric and this nonwoven fabric is attached to a holding device; or the fibers are formed into yarns and these yarns are disposed on the cleaning surface of the cleaning article; or the fibers are disposed, without forming either nonwoven fabrics or yarns, on the cleaning surface of the cleaning article.

In the process of producing the fibers that includes the steps of spinning, drawing, crimping, drying, etc., and in the process of producing cleaning articles with use of fibers, if the fibers are electrostatically charged, they will adhere to the production line and often discharge to the metallic part of the production line, thereby causing trouble in production. Therefore, in general, an antistatic agent is applied to the fibers in the step of spinning them to thereby prevent the fibers from being electrostatically charged, and the thus-processed fibers are then fed to the production line of cleaning articles.

Heretofore, for the antistatic agent, generally used are ionic surfactants such as anionic or cationic surfactants. Processed with the surfactant, the fibers are smooth-faced, and they are hardly charged by friction. In addition, they are made to have the ability to absorb moisture on their surface so as to allow free movement of electrons on their surface, and are thereby prevented from being statically electrified.

When such ionic surfactants of which the ability to prevent static electrification is high are adhered to fibers, it will solve the problem of static electrification in the production line of fibers. However, when the thus-processed fibers are used in cleaning articles, and when the cleaning articles comprising them are used, for example, for wiping floors, the fibers could not be electrostatically charged by friction and therefore could not electrostatically adsorb fine trash such as dust, dirt, hair, etc.

Therefore, in general, after the cleaning articles comprising the surfactant-processed fibers are fabricated, liquid paraffin, paraffin wax, adhesive resin or the like is applied onto their cleaning surface so as to increase the cleaning ability of the articles. Owing to the adhesive power of the paraffin or the like applied thereto, the cleaning articles can adsorb dust, dirt, etc. However, since the liquid paraffin and others are sticky, they will stick to floors, furniture and glass wiped with the cleaning articles, and will rather soil them. This is one problem with the cleaning articles.

In addition, if the fibers coated with the surfactant in the spinning step are too much smooth-faced, they could not be well bundled when formed into a tow. If so, the tow will loosen in the crimping step, and the fibers constituting it could not be uniformly crimped. Further, while the tow is conveyed in the initial stage in the production line of cleaning articles, the fibers constituting it will also loosen. This is another problem with the cleaning articles.

SUMMARY OF THE INVENTION

The present invention has been worked out in view of the shortcomings set forth above. It is, therefore, an object of the present invention to provide a cleaning article for which fibers are well processed in their production line without being too much electrostatically charged therein, but which, while in use, are electrostatically charged to a suitable degree to effectively adsorb dust and dirt.

According to the present invention, there is provided a cleaning article comprising fibers having at least a surfactant adhered thereto, wherein the surfactant is a mixture that contains from 45 to 76% by weight of a polyoxyethylene (POE) monoester of a fatty acid having from 5 to 15 carbon atoms, and the balance of the mixture is at least one compound selected from the group consisting of a POE monoester of a saturated fatty acid having from 16 to 22 carbon atoms, a POE monoester of an unsaturated fatty acid having from 16 to 22 carbon atoms, a POE diester of an unsaturated fatty acid having from 16 to 22 carbon atoms, and a POE diester of a saturated fatty acid having from 12 to 15 carbon atoms.

For example, the surfactant is a mixture that contains from 48 to 76% by weight of a POE monoester of a fatty acid having from 5 to 15 carbon atoms, and the balance of the mixture is at least one compound selected from the group consisting of a POE monoester of a saturated fatty acid having from 16 to 20 carbon atoms, a POE monoester of an unsaturated fatty acid having from 18 to 22 carbon atoms, and a POE diester of an unsaturated fatty acid having from 18 to 22 carbon atoms;

or the surfactant is a mixture that contains from 48 to 76% by weight of a POE monoester of a fatty acid having from 5 to 15 carbon atoms, and the balance of the mixture is at least one compound selected from the group consisting of a POE monoester of a saturated fatty acid having from 16 to 20 carbon atoms, a POE monoester of an unsaturated fatty acid having from 18 to 22 carbon atoms, and a POE diester of a saturated fatty acid having from 12 to 15 carbon atoms;

or the surfactant is a mixture that contains from 45 to 72% by weight of a POE monoester of a fatty acid having from 5 to 15 carbon atoms, and the balance of the mixture is at least one compound selected from the group consisting of a POE monoester of a saturated fatty acid having from 16 to 20 carbon atoms, and a POE diester of an unsaturated fatty acid having from 18 to 22 carbon atoms.

Preferably, the surfactant contains from 48 to 68% by weight of a POE monoester of a fatty acid having from 5 to 15 carbon atoms, or contains from 45 to 64% by weight of a POE monoester of a fatty acid having from 5 to 15 carbon atoms.

Also preferably, the surfactant contains from 5 to 40% by weight of a POE diester of an unsaturated fatty acid having from 18 to 22 carbon atoms, or contains from 5 to 40% by weight of a POE diester of a saturated fatty acid having from 12 to 15 carbon atoms.

The surfactant may be prepared by adding from 5 to 40% by weight of a POE diester of an unsaturated fatty acid having from 16 to 22 carbon atoms, to a mixture that contains from 75 to 85% by weight of a POE monoester of a fatty acid having from 5 to 15 carbon atoms, and contains, as the balance thereof, a POE ester of a fatty acid having from 16 to 22 carbon atoms.

The surfactant may be a mixture that contains from 50 to 70% by weight of a POE monoester of a fatty acid having from 5 to 15 carbon atoms and contains, as the balance thereof, a POE diester of an unsaturated fatty acid having from 18 to 22 carbon atoms.

In the POE monoester of a fatty acid having from 5 to 15 carbon atoms in the surfactant, the fatty acid is preferably a saturated fatty acid. Also preferably, the unsaturated fatty acid is oleic acid.

Also preferably, the number of moles of ethylene oxide constituting the POE fatty acid monoester and the POE fatty acid diester falls between 2 and 50.

Also preferably, the ratio by weight of the surfactant to the fibers falls between 0.1% and 1.5%.

The fibers may be made of at least one resin selected from the group consisting of polyester, polyethylene and polypropylene.

DESCRIPTION OF THE PREFERRED EMBODIMENTS

Figure 1A:
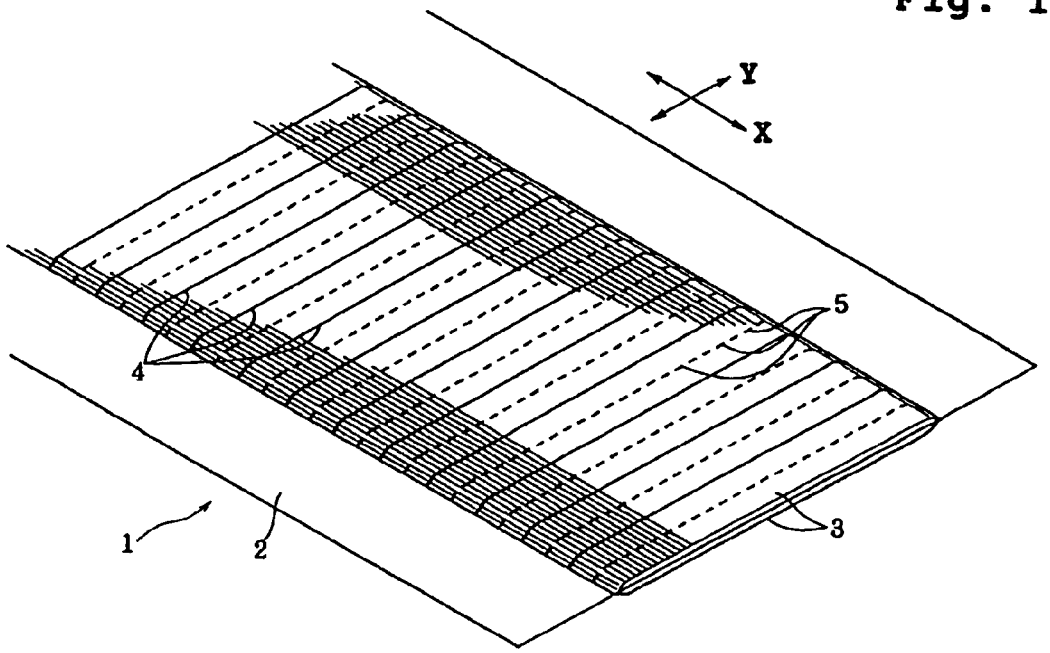
FIG. 1A is a perspective view showing a cleaning article according to one embodiment of the invention.
Figure 1B:
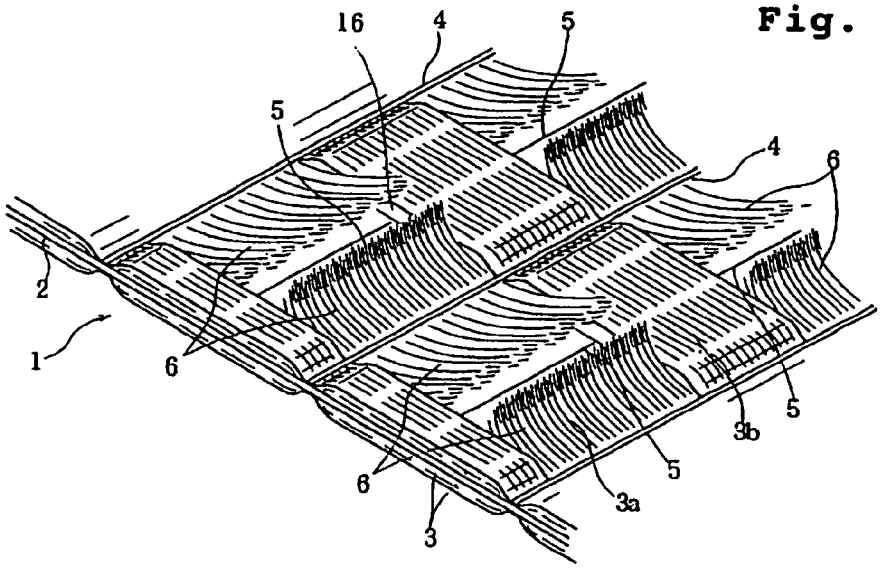
FIG. 1B is a partly enlarged view of FIG. 1A.
Figure 2:
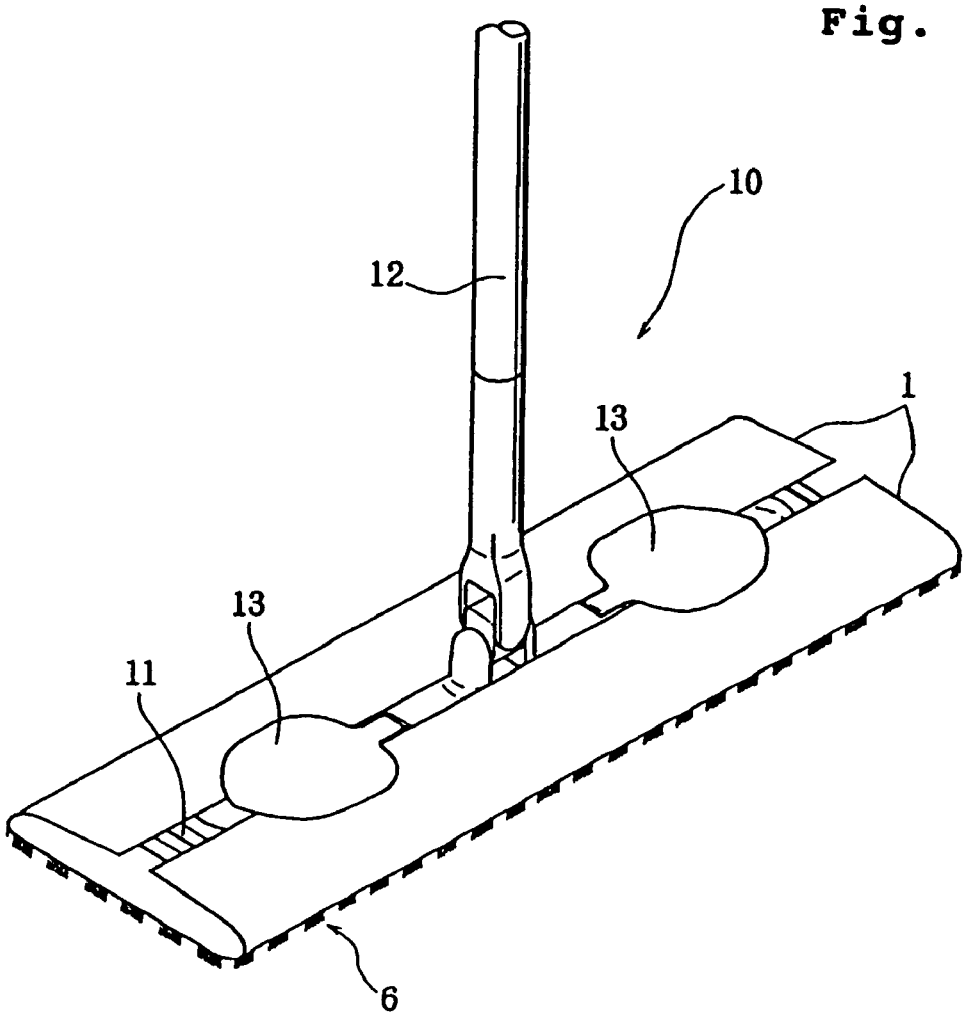
FIG. 2 is a perspective view showing a condition in which the cleaning article of FIG. 1A is attached to a holding device.

FIG. 1A is a perspective view showing a cleaning article according to one embodiment of the invention. FIG. 1B is a partly enlarged view of FIG. 1A. FIG. 2 is a perspective view showing a condition in which the cleaning article of FIG. 1A is attached to a holding device.

Of a cleaning article 1 of FIGS. 1A and 1B, both surfaces serve for cleaning purposes. As illustrated, the cleaning article 1 comprises a substrate sheet 2 formed from heat-fusible fibers, and filament layers 3 on both surfaces of the substrate sheet 2. The filament layer 3 is formed by opening (or debundlizing) a tow of heat-fusible filaments and stacking it on the substrate sheet 2 to extend in the X-direction of the cleaning article 1. The filament layers 3 thus stacked are then integrally joined to the substrate sheet 2 on joining lines 4 extending in the Y-direction crossing the X-direction. Between joining lines 4 adjacent to each other in the X-direction, moreover, the filament layers 3 are cut together with the substrate sheet 2 to form short cuts 5. These short cuts 5 are spaced at regular intervals, like linear perforations.

Between the adjacent joining lines 4, as shown in FIG. 1B, the filaments cut by formation of the short cuts 5 are generally indicated at 3*a*, while the remaining filaments extending between the adjacent joining lines 4 without cutting are generally indicated at 3*b*. The areas of the cut filaments 3*a* and the areas of the uncut filaments 3*b* alternate with each other in the Y-direction. Thus, there are formed brush-like portions 6 from the cut filaments 3*a* which are fixed to the substrate sheet 2 only at their one ends, between the adjacent joining lines 4.

As shown in FIG. 2, the cleaning article 1 thus manufactured may be attached to a holding device 10 for wiping operation. The holding device 10 comprises a plate 11 and a handle 12 mounted thereon. Concretely, the cleaning article 1 is attached to the holding device 10 in such a manner that its center portion having the filament layers 3 is laid on the lower surface of the plate 11 so that the brush-like portions 6 may face the objects such as floors to be wiped with them, and both side portions of the cleaning article 1 are folded back onto the upper surface of the plate 11 and held thereon by holding clips 13, 13.

When the cleaning article 1 is used for cleaning floors, etc., its brush-like portions 6 wipe off dust. In addition, the areas of the uncut filaments 3*b* form pockets 16 to catch dust therein.

The filaments may be made of polyethylene, polypropylene, polyester, etc. For example, preferred are core/sheath bicomponent fibers in which the core is polyester and the sheath is polyethylene. Also usable are core/sheath bicomponent fibers in which both the core and the sheath are polyester; the core is polyester and the sheath is polypropylene; both the core and the sheath are polypropylene; or the core is polypropylene and the sheath is polyethylene. The fibers may be mono-component fibers of single resin such as polyethylene, polypropylene or polyester alone.

Continuous filaments are produced through extrusion of molten resin, and they are bundled into a tow. The tow is then crimped. In the production line of fabricating the cleaning article 1 of FIG. 1 and FIG. 2, the tow is opened to debundlize the filaments from each other, spread into a predetermined width to have a uniform bulkiness, and then stacked on the substrate sheet 2. Thereafter, the joining lines 4 and the cuts 5 are formed.

Before bundled into a tow, the filaments for the cleaning article 1 are coated with a mixture of two or more nonionic surfactants. For this, for example, the filaments are, after spun, brought into contact with a roller which has been previously impregnated with the surfactant mixture.

The surfactant mixture to be applied to the filaments comprises two different types of surfactants. In this, the requirement of one surfactant (first surfactant) is that the filaments processed with it are not too much smooth-faced in order that they can be electrostatically charged in some degree and can therefore catch dust when the cleaning article 1 comprising them is used for wiping floors, furniture, glass, etc., while, on the other hand, they can be well bundled into a tow in the production line of the cleaning article 1. The requirement of another surfactant (second surfactant) is that the filaments processed with it can be smooth-faced in such a controlled manner that they are not too much electrostatically charged by friction in the step of bundling the filaments into a tow and also in the production line of producing cleaning articles so as to prevent the filaments from adhering to the working devices to be cut or broken therein.

In the present invention, used are nonionic surfactants, polyoxyethylene (POE) fatty acid esters. Of the POE fatty acid esters, those in which the number of carbon atoms constituting the fatty acid moiety is larger have a higher function of smoothing the surface of filaments processed with them serving as surfactant.

For the first surfactant, for example, herein used are polyoxyethylene (POE) monoesters of fatty acids having from 5 to 15 carbon atoms; and for the second surfactant, used are POE esters of fatty acids having a larger number of carbon atoms than those in the POE monoesters for the first surfactant. Concretely, the second surfactant is at least one compound selected from the group consisting of POE monoesters of saturated fatty acids having from 16 to 22 carbon atoms, POE monoesters of unsaturated fatty acids having from 16 to 22 carbon atoms, POE diesters of unsaturated fatty acids having from 16 to 22 carbon atoms, and POE diesters of saturated fatty acids having from 12 to 15 carbon atoms.

With a mixture of such nonionic surfactants applied to the filaments, the filaments are hardly cut or broken since their friction against the working devices in the production line of fabricating cleaning articles is reduced. In the formation of filaments, on the other hand, the filaments can be well bundled into a tow. In the thus-fabricated cleaning articles, moreover, the filaments can be electrostatically charged by friction to a suitable degree, and can well adsorb dust.

The polyoxyethylene (POE) fatty acid monoesters are represented by the following formula (1); and the polyoxyethylene (POE) fatty acid diesters are by the following formula (2). In these, R indicates a hydrocarbon radical.

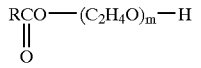

(1)

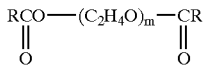

(2)

The number of carbon atoms that constitute the fatty acid moiety in these esters is indicated by n in $C_nH_{2n}O_2$ for saturated fatty acids, and in $C_nH_{2n-2}O_2$ or $C_nH_{2n-4}O_2$ for unsaturated fatty acids.

Fatty acids having from 5 to 15 carbon atoms include, for example, caproic acid, caprylic acid, capric acid, undecanoic acid, lauric acid, and myristic acid; and fatty acids having from 16 to 22 carbon atoms include, for example, palmitic acid, stearic acid, behenic acid, oleic acid, linolic acid, and erucic acid.

In one preferred embodiment of the invention, used for the surfactant are POE monoesters of coconut oil fatty acid in which the proportion of fatty acids having from 5 to 15 carbon atoms is high.

Coconut oil fatty acid contains saturated fatty acids in the following ratio. For example, it contains from 0 to 0.8% of caproic acid (6), from 5.5 to 9.5% of caprylic acid (8), from 4.5 to 9.5% of capric acid (10), from 44 to 52% of lauric acid (12), from 13 to 19% of myristic acid (14), from 7.5 to 10.5% of palmitic acid (16), from 1 to 3% of stearic acid (18) and from 5 to 8% of arachic acid (20). In these, the parenthesized number indicates the number of carbon atoms constituting each fatty acid.

In addition, coconut oil fatty acid further contains unsaturated fatty acids in the following ratio. For example, it contains from 0 to 0.4% of hexadecenoic acid (16), from 5 to 8% of oleic acid (18), from 1.5 to 2.5% of linolic acid (18), and from 0.15 to 0.6% of unsaponifiable matters. In these, the parenthesized number indicates the number of carbon atoms constituting each unsaturated fatty acid.

In another preferred embodiment of the invention, used for the surfactant is a mixture comprising a POE monoester that includes those of coconut oil fatty acid as above, and a POE diester of an unsaturated fatty acid having from 16 to 22, preferably from 18 to 22 carbon atoms. The unsaturated fatty acid having from 16 to 22 carbon atoms includes, for example, oleic acid, linolic acid, linolenic acid, and erucic acid. For the surfactant, also used is a mixture comprising a POE monoester that includes those of coconut oil fatty acid as above, and a POE diester of a saturated fatty acid having from 12 to 15 carbon atoms.

Preferably, essential saturated fatty acids only, or saturated fatty acids and unsaturated fatty acids are selected from coconut oil fatty acid, and these are formulated to prepare a mixture comprising from 75 to 85% by weight of POE monoesters of saturated fatty acids having from 5 to 15 carbon atoms and containing, as the balance thereof, POE monoesters of saturated fatty acids having from 16 to 22 carbon atoms. Apart from this, they may be formulated to prepare a mixture comprising from 75 to 85% by weight of POE monoesters of saturated fatty acids having from 5 to 15 carbon atoms and containing, as the balance thereof, POE monoesters of saturated fatty acids having from 16 to 22 carbon atoms and POE monoesters of unsaturated fatty acids having from 16 to 22 carbon atoms.

To the thus-prepared mixture, added are any of POE diesters of unsaturated fatty acids having from 16 to 22 carbon atoms, and POE diesters of saturated fatty acids having from 12 to 15 carbon atoms, in a ratio falling between 5 and 40% by weight.

The resulting mixture comprises from 45 to 76% by weight of polyoxyethylene (POE) monoesters of fatty acids having from 5 to 15 carbon atoms, and contains, as the balance thereof, at least one compound selected from the group consisting of POE monoesters of saturated fatty acids having from 16 to 22 carbon atoms, POE monoesters of unsaturated fatty acids having from 16 to 22 carbon atoms, POE diesters of unsaturated fatty acids having from 16 to 22 carbon atoms, and POE diesters of saturated fatty acids having from 12 to 15 carbon atoms.

In these polyoxyethylene esters, the number of mols of ethylene oxide may fall within a range of from 2 to 50. This corresponds to m in formula (1).

In the cleaning article of the invention, the amount of the nonionic surfactant to be adhered to the filament is preferably so controlled that the ratio by weight of the surfactant to the filament falls between 0.1% and 1.5%, more preferably between 0.3 and 0.7%. If the ratio is smaller than 0.1%, the filaments could not keep the necessary antistatic property and surface smoothness in the process of producing and working them; but if larger than 1.5%, finishes applied to the filaments could not stay thereon.

In the process of processing the filaments, a dust-collecting agent not having the ability to prevent static electrification may be applied to the filaments, if desired. This is for further augmenting the dust-collecting ability of the filaments. For example, the dust-collecting agent includes liquid paraffin, paraffin wax, and adhesive resin. Also if desired, any substance of, for example, deodorizer, moisturizer and bacteriostat may be applied to cleaning article of the invention.

The cleaning article of the invention is not limited to the embodiment illustrated in FIG. 1 in which filament layers are stacked on a substrate sheet. For example, the continuous filaments having the surfactant applied thereto may be cut into staple fibers having a predetermined length. In this case, the staple fibers may be stacked and fused onto a substrate sheet; or the staple fibers may be formed into a nonwoven fabric not processed with water jets (so that the surfactant will not drop off), such as a through-air bonded nonwoven fabric or point-bonded nonwoven fabric, and this nonwoven fabric may be provided on the cleaning face of the cleaning article; or the staple fibers may be fixed to a substrate sheet to form brush-like portions. It is also possible to plant a large number of twisted yarns of the continuous filaments in a substrate sheet.

If desired, the filaments coated with the nonionic surfactant mixture may be mixed with any other material to construct the cleaning article of the invention. Preferably, the additional material is not coated with a highly antistatic surfactant.

EXAMPLES

The invention is described in more detail with reference to the following Examples, which, however, are not intended to restrict the scope of the invention.

A mixture of nonionic surfactants shown in Table 1 was applied to filaments in the spinning step. Using the filaments (continuous filaments), cleaning articles as in FIG. 1 were fabricated.

TABLE 1

| | Range of the Number of Carbon Atoms in Fatty Acids | Mean of Carbon Atoms in Fatty Acids | Saturated/ Unsaturated | Monoester/ Diester | Blend Ratio (wt. %) | Number of Mols of Ethyleneoxide (EO) |
|---|---|---|---|---|---|---|
| Surfactant A | 5–15 | 12.1 | saturated | mono | 80% | 20 |
| | 16–20 | 16.5 | saturated | mono | 12% | 20% |
| | 18–22 | 18.2 | unsaturated | mono | 8% | 20 |
| Surfactant B | 12–15 | 14.2 | saturated | mono | 75% | 20 |
| | 16–20 | 16.3 | saturated | mono | 25% | 20 |
| Surfactant C | 12–15 | 13.6 | saturated | mono | 100% | 20 |
| Surfactant X | 18–22 | 18.2 | unsaturated | di | 100% | 14 |
| Surfactant Y | 12–15 | 13.5 | saturated | di | 100% | 14 |

"A" is a mixture of POE esters of coconut oil fatty acid. Concretely, this is a mixture of polyethylene monoesters comprised of 80% by weight of POE monoesters of saturated fatty acids having from 5 to 15 carbon atoms, 12% by weight of POE monoesters of saturated fatty acids having from 16 to 20 carbon atoms, and 8% by weight of POE monoesters of unsaturated fatty acids having from 18 to 22 carbon atoms.
"B" is a mixture prepared by selectively formulating the essential saturated fatty acids in coconut oil fatty acid. Concretely, this is a mixture of polyoxyethylene monoesters comprised of 75% by weight of POE monoesters of saturated fatty acids having from 5 to 15 carbon atoms, and 25% by weight of POE monoesters of saturated fatty acids having from 16 to 20 carbon atoms.
"C" is a mixture prepared by selectively formulating the saturated fatty acids having a smaller number of carbon atoms in coconut oil fatty acid. Concretely, this is a mixture of POE monoesters of saturated fatty acids having from 12 to 15 carbons atoms.
"X" is a mixture of POE diesters on unsaturated fatty acids (oleic acid) having from 18 to 22 carbon atoms; and
"Y" is a mixture of POE diesters of saturated fatty acids having from 12 to 15 carbon atoms.

The surfactants were selectively mixed, and the resulting surfactant mixtures were applied to filaments in the spinning step. The filaments were tested for their processability into a tow and in the production process of the cleaning articles, and the cleaning articles thus fabricated were tested for their ability to electrostatically catch dust. The filaments tried herein are core/sheath bicomponent fibers in which the core is polyester and the sheath is polyethylene.

For evaluating their processability, the filaments were visually checked as to whether or not they were smoothly processed with no trouble in the filament-production process including spinning, drawing, crimping, etc., and in the sheet-production process including opening, joining, etc. Thus checked, the fibers were ranked as follows. A: The filaments hardly cause trouble in both of the filament-production process and the sheet-production process, and they are good for practical use. B: The filaments cause a little trouble in any one or both of the filament-production process and the sheet-production process, but they are acceptable for practical use. C: The filaments cause much trouble in any one or both of the filament-production process and the sheet-production process, and they are unacceptable for practical use.

For evaluating their ability to electrostatically catch dust, the cleaning articles fabricated as in FIG. 1 were attached to holding devices as in FIG. 2. Every cleaning article thus attached was rubbed back and forth against a vinylic floor for a total of five times or so to thereby generate static electricity, and the quantity of static electricity generated was counted with a static electricity gauge. In another test for determining the relationship between the quantity of static electricity of the electrostatically charged sheet and the power of the sheet to attract dust, it was confirmed that the sheet having gained static electricity of about 1000 V/inch attracts about 10-mmϕ cotton dust spaced from it by about 20 mm. From the result, it is concluded that the cleaning articles fabricated herein, if having gained static electricity of 1000 V/inch in the floor rubbing test, have enough power to adsorb dust in cleaning applications. Based on the test result, the quantity of static electricity of each cleaning article tested was measured, and the cleaning articles were ranked as follows. A: Immediately after the floor rubbing test, the cleaning articles gained plenty of charges, and after 5 seconds, they still kept static electricity of 1000 V/inch or more. B: Immediately after the test, the cleaning articles gained plenty of charges, but after 5 seconds, their static electricity decreased to lower than 1000 V/inch. C: Even immediately after the test, the cleaning articles gained static electricity of only 1000 V/inch or lower.

The blend ratio of the surfactants used, and the test results are shown in Tables 2 and 3 below. In these, the blend ratio of the surfactants used is in terms of % by weight of each surfactant. In addition, also shown in these are the details of the blend ratio of the POE monoesters of saturated fatty acids having from 5 to 15 carbon atoms, the POE monoesters of saturated fatty acids having from 16 to 20 carbon atoms, the POE monoesters of unsaturated fatty acids having from 18 to 22 carbon atoms, the POE diesters of unsaturated fatty acids having from 18 to 22 carbon atoms, and the POE diesters of saturated fatty acids having from 12 to 15 carbon atoms in each surfactant mixture.

TABLE 2

| | Surfactant A | Surfactant B | Surfactant X | Surfactant Y | Process-ability | Electrostatic Dust Collection | C5–15 mono | C16–20 mono, saturated | C18–22 mono, unsaturated | C18–22 di, unsaturated | C12–15 di, saturated |
|---|---|---|---|---|---|---|---|---|---|---|---|
| Co. Ex. 1 | 100 | | 0 | | C | A | 80 | 12 | 8 | 0 | |
| Example 1 | 95 | | 5 | | B | A | 76 | 11.4 | 7.6 | 5 | |
| Example 2 | 90 | | 10 | | B | A | 72 | 10.8 | 7.2 | 10 | |
| Example 3 | 85 | | 15 | | A | A | 68 | 10.2 | 6.8 | 15 | |
| Example 4 | 60 | | 40 | | A | A | 48 | 7.2 | 4.8 | 40 | |
| Co. Ex. 2 | 55 | | 45 | | C | A | 44 | 6.6 | 4.4 | 45 | |
| Example 5 | 95 | | | 5 | B | A | 76 | 11.4 | 7.6 | | 5 |
| Example 6 | 90 | | | 10 | B | A | 72 | 10.8 | 7.2 | | 10 |
| Example 7 | 85 | | | 15 | A | A | 68 | 10.2 | 6.8 | | 15 |
| Example 8 | 60 | | | 40 | A | A | 48 | 7.2 | 4.8 | | 40 |
| Co. Ex. 3 | 55 | | | 45 | C | A | 44 | 6.6 | 4.4 | | 45 |
| Co. Ex. 4 | | 100 | 0 | | C | A | 75 | 25 | | 0 | |
| Example 9 | | 95 | 5 | | B | A | 71.25 | 23.75 | | 5 | |
| Example 10 | | 90 | 10 | | B | A | 67.5 | 22.5 | | 10 | |
| Example 11 | | 85 | 15 | | A | A | 63.75 | 21.25 | | 15 | |
| Example 12 | | 60 | 40 | | A | A | 45 | 15 | | 40 | |
| Co. Ex. 5 | | 55 | 45 | | C | A | 41.25 | 13.75 | | 45 | |

The results in Table 2 above confirm the following:

(1) As in Examples 1 to 4 in which were used the surfactant A and the surfactant X, the surfactant mixture preferably contains from 48 to 76% by weight, more preferably from 48 to 68% by weight of POE monoesters of saturated fatty acids having from 5 to 15 carbon atoms, and preferably contains from 5 to 40% by weight, more preferably from 15 to 40% by weight of POE diesters of unsaturated fatty acids having from 18 to 22 carbon atoms.

(2) As in Examples 5 to 8 in which were used the surfactant A and the surfactant Y, the surfactant mixture preferably contains from 48 to 76% by weight, more preferably from 48 to 68% by weight of POE monoesters of saturated fatty acids having from 5 to 15 carbon atoms, and preferably contains from 5 to 40% by weight, more preferably from 15 to 40% by weight of POE diesters of saturated fatty acids having from 12 to 15 carbon atoms.

(3) As in Examples 9 to 12 in which were used the surfactant B and the surfactant X, the surfactant mixture preferably contains from 45 to 72% by weight, more preferably from 45 to 64% by weight of POE monoesters of saturated fatty acids having from 5 to 15 carbon atoms, and preferably contains from 5 to 40% by weight, more preferably from 15 to 40% by weight of POE diesters of unsaturated fatty acids having from 18 to 22 carbon atoms.

TABLE 3

| | Surfactant C | Surfactant X | Process-ability | Electrostatic Dust Collection | C5–15 mono | C16–20 mono, saturated | C18–22 mono, unsaturated | C18–22 di, unsaturated | C12–15 di, saturated |
|---|---|---|---|---|---|---|---|---|---|
| Co. Ex. 6 | 100 | 0 | C | A | 100 | | | 0 | |
| Co. Ex. 7 | 90 | 10 | C | A | 90 | | | 10 | |
| Co. Ex. 8 | 80 | 20 | C | A | 80 | | | 20 | |
| Example 13 | 70 | 30 | B | A | 70 | | | 30 | |
| Example 14 | 60 | 40 | A | A | 60 | | | 40 | |
| Example 15 | 50 | 50 | A | A | 50 | | | 50 | |

The results in Table 3 above confirm the following:

(4) As in Examples 13 to 15 in which were used the surfactant C and the surfactant X, the surfactant mixture preferably contains from 50 to 70% by weight, more preferably from 50 to 60% by weight of POE monoesters of saturated fatty acids having from 5 to 15 carbon atoms, and preferably contains from 30 to 50% by weight, more preferably from 40 to 50% by weight of POE diesters of unsaturated fatty acids having from 18 to 22 carbon atoms.

As described in detail hereinabove, the present invention provides cleaning articles for which fibers are well processed in their production line without being too much electrostatically charged therein, but which, while in use, are electrostatically charged to a suitable degree to effectively adsorb dust and dirt.

While the invention has been described in detail and with reference to specific embodiments thereof, it will be apparent to one skilled in the art that various changes and modifications can be made therein without departing from the spirit and scope thereof.

The invention claimed is:

1. A cleaning article comprising fibers having at least a surfactant adhered thereto, wherein the surfactant is a mixture that contains from 45 to 76% by weight of a polyoxyethylene (POE) monoester of a fatty acid having from 5 to 15 carbon atoms, and the balance of the mixture is at least one compound selected from the group consisting of a POE monoester of a saturated fatty acid having from 16 to 22 carbon atoms, a POE monoester of an unsaturated fatty acid having from 16 to 22 carbon atoms, a POE diester of an unsaturated fatty acid having from 16 to 22 carbon atoms, and a POE diester of a saturated fatty acid having from 12 to 15 carbon atoms.

2. The cleaning article as set forth in claim 1, wherein the surfactant is a mixture that contains from 48 to 76% by weight of a POE monoester of a fatty acid having from 5 to 15 carbon atoms, and the balance of the mixture is at least one compound selected from the group consisting of a POE monoester of a saturated fatty acid having from 16 to 20 carbon atoms, a POE monoester of an unsaturated fatty acid having from 18 to 22 carbon atoms, and a POE diester of an unsaturated fatty acid having from 18 to 22 carbon atoms.

3. The cleaning article as set forth in claim 1, wherein the surfactant is a mixture that contains from 48 to 76% by weight of a POE monoester of a fatty acid having from 5 to 15 carbon atoms, and the balance of the mixture is at least one compound selected from the group consisting of a POE monoester of a saturated fatty acid having from 16 to 20 carbon atoms, a POE monoester of an unsaturated fatty acid having from 18 to 22 carbon atoms, and a POE diester of a saturated fatty acid having from 12 to 15 carbon atoms.

4. The cleaning article as set forth in claim 1, wherein the surfactant is a mixture that contains from 45 to 72% by weight of a POE monoester of a fatty acid having from 5 to 15 carbon atoms, and the balance of the mixture is at least one compound selected from the group consisting of a POE mono ester of a saturated fatty acid having from 16 to 20 carbon atoms, and a POE diester of an unsaturated fatty acid having from 18 to 22 carbon atoms.

5. The cleaning article as set forth in claim 1, wherein the surfactant contains from 48 to 68% by weight of a POE monoester of a fatty acid having from 5 to 15 carbon atoms.

6. The cleaning article as set forth in claim 1, wherein the surfactant contains from 45 to 64% by weight of a POE monoester of a fatty acid having from 5 to 15 carbon atoms.

7. The cleaning article as set forth in claim 1, wherein the surfactant contains from 5 to 40% by weight of a POE diester of an unsaturated fatty acid having from 18 to 22 carbon atoms.

8. The cleaning article as set forth in claim 1, wherein the surfactant contains from 5 to 40% by weight of a POE diester of a saturated fatty acid having from 12 to 15 carbon atoms.

9. The cleaning article as set forth in 1, wherein the surfactant is prepared by adding from 5 to 40% by weight of a POE diester of an unsaturated fatty acid having from 16 to 22 carbon atoms, to a mixture that contains from 75 to 85% by weight of a POE monoester of a fatty acid having from 5 to 15 carbon atoms and contains, as the balance thereof, a POE ester of a fatty acid having from 16 to 22 carbon atoms.

10. The cleaning article as set forth in claim 1, wherein the surfactant is a mixture that contains from 50 to 70% by weight of a POE monoester of a fatty acid having from 5 to 15 carbon atoms and contains, as the balance thereof, a POE diester of an unsaturated fatty acid having from 18 to 22 carbon atoms.

11. The cleaning article as set forth in claim 1, wherein in the POE monoester of a fatty acid having from 5 to 15 carbon atoms in the surfactant, the fatty acid is a saturated fatty acid.

12. The cleaning article as set forth in claim 1, wherein the unsaturated fatty acid is oleic acid.

13. The cleaning article as set forth in claim 1, wherein the number of moles of ethylene oxide constituting the POE fatty acid monoester and the POE fatty acid diester falls between 2 and 50.

14. The cleaning article as set forth in claim 1, wherein the ratio by weight of the surfactant to the fibers falls between 0.1% and 1.5%.

15. The cleaning article as set forth in claim 1, wherein the fibers are made of at least one resin selected from the group consisting of polyester, polyethylene and polypropylene.

16. The cleaning article as set forth in claim 2, wherein the surfactant contains from 48 to 68% by weight of a POE monoester of a fatty acid having from 5 to 15 carbon atoms.

17. The cleaning article as set forth in claim 3, wherein the surfactant contains from 48 to 68% by weight of a POE monoester of a fatty acid having from 5 to 15 carbon atoms.

18. The cleaning article as set forth in claim 4, wherein the surfactant contains from 45 to 64% by weight of a POE monoester of a fatty acid having from 5 to 15 carbon atoms.

19. The cleaning article as set forth in claim 2, wherein the surfactant contains from 5 to 40% by weight of a POE diester of an unsaturated fatty acid having from 18 to 22 carbon atoms.

20. The cleaning article as set forth in claim 4, wherein the surfactant contains from 5 to 40% by weight of a POE diester of an unsaturated fatty acid having from 18 to 22 carbon atoms.

21. The cleaning article as set forth in claim 3, wherein the surfactant contains from 5 to 40% by weight of a POE diester of a saturated fatty acid having from 12 to 15 carbon atoms.

22. The cleaning article as set forth in claim 2, wherein the surfactant is prepared by adding from 5 to 40% by weight of a POE diester of an unsaturated fatty acid having from 18 to 22 carbon atoms, to a mixture that contains from 75 to 85% by weight of a POE monoester of a fatty acid having from 5 to 15 carbon atoms and contains, as the balance thereof, at least one compound selected from the group consisting of a POE monoester of a saturated fatty acid having from 16 to 20 carbon atoms, and a POE monoester of an unsaturated fatty acid having from 18 to 22 carbon atoms.

23. The cleaning article as set forth in claim 4, wherein the surfactant is prepared by adding from 5 to 40% by weight of a POE diester of an unsaturated fatty acid having from 18 to 22 carbon atoms, to a mixture that contains from 75 to 85% by weight of a POE monoester of a fatty acid having from 5 to 15 carbon atoms and contains, as the balance thereof, a POE monoester of a saturated fatty acid having from 16 to 20 carbon atoms.

* * * * *